United States Patent [19]

Yin

[11] Patent Number: 4,999,463

[45] Date of Patent: Mar. 12, 1991

[54] ARC STALLING ELIMINATING DEVICE AND SYSTEM

[75] Inventor: Simon Yin, Fremont, Calif.

[73] Assignee: Square D Company, Palatine, Ill.

[21] Appl. No.: 259,242

[22] Filed: Oct. 18, 1988

[51] Int. Cl.[5] ..... H01H 33/66

[52] U.S. Cl. ..... 200/144 B

[58] Field of Search ..... 200/144 B

[56] References Cited

U.S. PATENT DOCUMENTS

| | | | |
|---|---|---|---|
| 3,462,572 | 8/1969 | Sofianek | 200/144 B |
| 3,522,399 | 7/1970 | Crouch | 200/144 B |
| 3,546,407 | 12/1970 | Schneider | 200/144 B |
| 3,683,139 | 8/1972 | Ludwig | 200/144 B |
| 3,711,665 | 1/1973 | Dethlefsen | 200/144 B |
| 3,809,836 | 5/1974 | Crouch | 200/144 B |
| 4,293,748 | 10/1981 | Sakuma et al. | 200/144 B |
| 4,324,960 | 4/1982 | Aoki et al. | 200/144 B |
| 4,806,714 | 2/1989 | Aoki | 200/144 B |

FOREIGN PATENT DOCUMENTS

| | | | |
|---|---|---|---|
| 3435637 | 9/1984 | Fed. Rep. of Germany | 200/144 B |
| 3808248 | 7/1988 | Fed. Rep. of Germany | 200/144 B |

*Primary Examiner*—Robert S. Macon

*Attorney, Agent, or Firm*—Flehr, Hohbach, Test, Albritton & Herbert

[57] ABSTRACT

An arc stalling eliminating electrode having a sealed vacuum cylinder within which are a pair of confronting electrodes disposed within the cylinder and mounted for movement between a first closed position in which the electrodes have contact faces which engage one another and a second open position in which the contact faces are spaced apart. The confronting electrodes move between the first and second positions when a high voltage AC current appears across the electrodes in order to interrupt that current. The interrupted current generates an arc between the electrodes until it goes to zero. The electrodes are configured such that the arc generated during separation of the electrode faces is caused to move to an outer periphery of the electrodes and around the latter with substantially no stalling in its movement, whereby the possibility of damaging the electrodes and the arced metal vapor due to the arc is minimized.

3 Claims, 2 Drawing Sheets

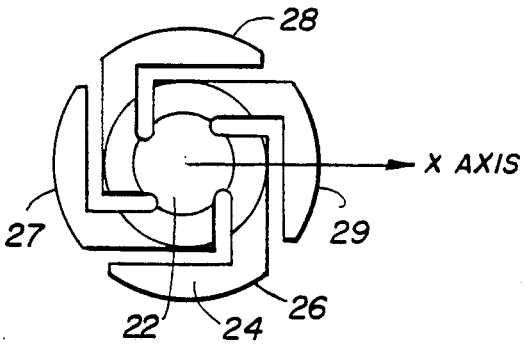
Fig.5
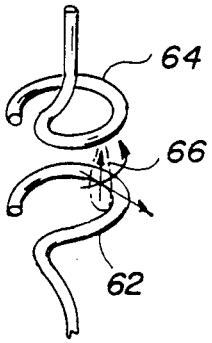
Fig.6
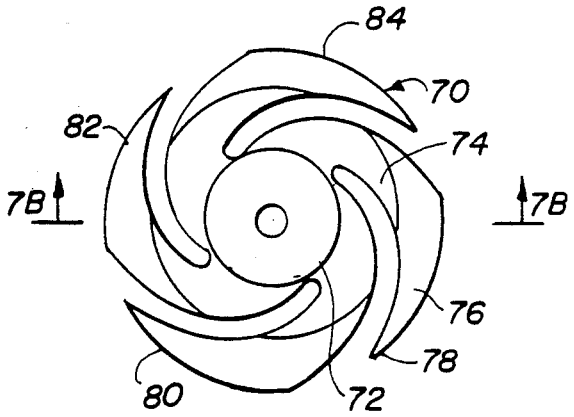
Fig.7A
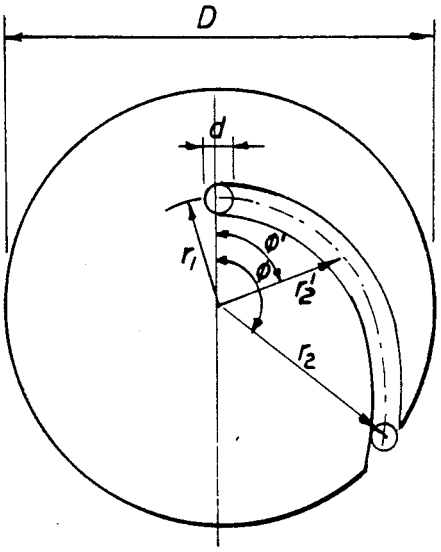
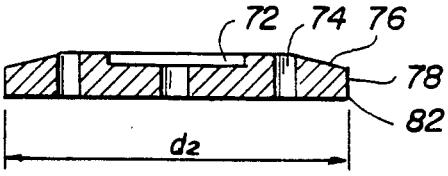
Fig.7B
$r_2 = (D+d)/2$ -----1
$r_1 = r_2/\phi \sin\theta + 1$ ----2
$r_2' = r_1 + (\frac{r_2 - r_1}{\phi})\phi'$ -----3
Fig.8

ARC STALLING ELIMINATING DEVICE AND SYSTEM

BACKGROUND OF THE INVENTION

1. Field of the Invention

The present invention relates generally to a configuration of electrodes in a high voltage interrupter. More particularly, the present invention relates to electrodes specifically designed to eliminate arc stalling in a high voltage vacuum interrupter.

2. Summary of the Prior Art

The present invention is used in high voltage interrupters. An interrupter is a device containing two electrode heads through which high current is transferred as the electrodes are in closed position. When the overload current reaches a certain predetermined level the electrodes separate preventing further current flow across the electrodes. The interrupter works much like a fuse. When a large current flows across a fuse it "burns" out to prevent overload current flow. The difference between an interrupter and a fuse is that once a fuse is blown it has to be replaced. Contrarily, an interrupter's electrode are placed back in contact with one another once the overload current has subsided, thus it can be used continuously.

When the electrodes are separated, because of overload current, at any time during the sinusoidal period of the AC current that is not a zero point, an arc occurs between the separated electrodes until the next zero point is reached at which the arc is to be completely extinguished as this current zero point.

This arc can be damaging to the electrode contact faces. First, an arc current can ionize the electrode material causing the electrode surfaces to pit. This pitting causes an uneven contact face which results in surface roughness on the contact faces. Second, arcing can heat up the surface of the contact faces to their melting point. When this occurs the electrodes may fuse together when they recombine.

Conventionally, the vacuum interrupter is characterized by its rapid recovery of the dielectric strength of the vacuum gap at the critical current zero point. The presence of arc vapor from arcing affects the ability of the contact gap to withstand high voltage stress. The recovery characteristics are influenced not only by the electrode material but also by the electrode geometry.

It is well known that at high current level, the arc column is constricted under the influence of the local magnetic field which aggravates the local heating of the electrode and hence the metal vapor dispersed into the vacuum gap accelerates. It is also well known that the local magnetic fields from the current passing through the electrodes can act on the current forming the arc to cause the latter to move across the electrode. One effective method of avoiding local overheating of the electrode surfaces is to ensure that the arc moves over the surface by the self-induced magnetic field interacting with the arc column in order to spread out the local heat concentration.

Different types and shapes of electrode geometries have been studied to achieve continuous movement of the arc by the self-induced field. The first of these is discussed in FIG. 4. The second is discussed in FIG. 5.

Referring to FIG. 4, a top view of an electrode 8 is shown. The region from circular line 16 to circular line 18 is the contact face 17 of the electrode. It is raised vertically above (out of the paper) from an inner portion 19, inside line 18, and flanges 10–15 which extend outside of line 16. The inner portion 19 is depressed initiating the self induced magnetic field to move the arc from the contact face 17 out onto the flanges 10–15. The geometry of the electrode 8 is configured so that the arc will run out on one of the flanges 10–15. The reason why the arc moves is described in more detail below in the detailed description.

The problem with the configuration of FIG. 4 is that the arc stalls on the isolated flange since the flanges are significantly isolated from one another. This means it runs from the contact face 17 of the electrode to a particular flange and stays on that particular flange due to inefficient arc rotation of such isolated flange. Eventually the isolated flange will melt away or into another flange destroying its ability to maintain the arc away from the contact face. Over time all of the flanges are reduced by heating and pitting. The term used to describe when an arc slows down or stops on a particular segment of the electrode causing that segment to heat up is called arc stalling. Eventually the contact faces bare the local heating of the arc which increases the metal vapor, resulting in inability of dielectric recovery.

To overcome stalling on a particular flange a configuration has arose which allows the arc to jump from one flange to another, eliminating stalling on one flange. This configuration is shown in FIG. 5. The center portion 22 is cut below the contact face 23. Outside the contact face is a periphery plate 24 sloped away from the contact face 23. Rectangular slots are cut through the contact face 23 and the periphery plate 24 to create a plurality of flanges 26–29. The slots separating the flanges 26–29 promote directional self-induced magnetic field. Their geometry is intended to permit the arc to rotate from one flange the other. By permitting the arc to jump from one flange to another this configuration reduces arc stalling, which in turn adds to the longevity of the flanges 26–29 and the contact face 24.

The problem with the configuration of FIG. 5 is that the slots are cut rectangularly. The magnetic field created in the contact face which forces the arc to wave outward has to push the arc through two right angles. Focusing on flange 26, a magnetic field is created by the electrical current. The magnetic field is perpendicular to the x-axis and pushes the arc outward from the center along the x-axis. Within a very short distance, however, the flange 26 makes a right angle. The arc has developed little velocity by this point and the magnetic field is weak. Thus, the arc undergoes stalling as it makes the turn. This problem is compounded by a second right angle on the flange after it has left the contact face 23 and entered the periphery plate 24. There the arc undergoes similar stalling.

The slowing down of the arc at the two right angles increases the time it takes the arc to move off of the contact surface 23. That increases the damage to the contact surface 23 caused by pitting and overheating. The pitting and overheating caused by the arc stalling at the right angles will allow the electrodes to fuse when recombined.

Another shortcoming of the device of FIG. 5 is that it is made quite large. The rationale behind its size is that the larger the periphery, the further the arc will be from the contact faces, i.e., the less heat build up on the contact faces and the less pitting. Unfortunately, the larger the electrode the larger its housing has to be, thus the less economical of the design of the electrode.

Thus Applicant has found it not only desirable to eliminate arc stalling on the electrode but also desirable to reduce the size of the electrode for a given power rating.

SUMMARY OF THE INVENTION

Accordingly, it is an object of the invention to configure a high-voltage interrupter electrode which minimizes and preferably entirely eliminates arc stalling.

It is another object of the invention to reduce the size of an electrode that eliminates arc stalling for a given power rating.

It is another object of the present invention to maximize the speed at which an arc moves from the contact face to the outer periphery on an electrode and maintain the efficient rotation on tho electrode peripheries.

The attainment of these and related objects may be achieved through use of a novel electrode which is designed in accordance with the present invention to eliminate arc stalling. As will be disclosed in more detail below, this electrode has a sealed vessel within which are a pair of confronting electrodes disposed within the vessel and mounted for movement between a first closed position in which the electrodes have contact faces which engage one another and a second open position in which the contact faces are spaced apart.

The electrodes are configured such that the arc generated during separation of the electrode faces is caused to move to an outer periphery of the electrodes and around the latter with substantially no stalling in its movement, whereby the possibility of damaging the electrodes due to the arc is minimized.

The attainment of the foregoing and related objects, advantages and features of the invention should be more readily apparent to those skilled in the art, after review of the following more detailed description of the invention, taken together with the drawings, in which:

DETAILED DESCRIPTION OF THE DRAWINGS

FIG. 5 is a top view of another electrode of the prior art.

FIG. 6 is diagrammatically illustrates how the arcing current produces a magnetic field perpendicular to the contact plane of the electrode of the preferred embodiment.

FIG. 7(*a*) is a top view of the electrode of the preferred embodiment.

FIG. 7(*b*) is a side cross-sectional view of the electrode of the preferred embodiment.

FIG. 8 is a representation of the geometry of the slots within the electrode of the preferred embodiment.

DETAILED DESCRIPTION OF THE PREFERRED EMBODIMENT

A high voltage interrupter may achieve interruption in a variety of mediums including oil, pressurized gas, and vacuum. Although the present invention is applicable to all interrupters, the preferred embodiment is discussed solely in application to a vacuum interrupter.

Figure 1:
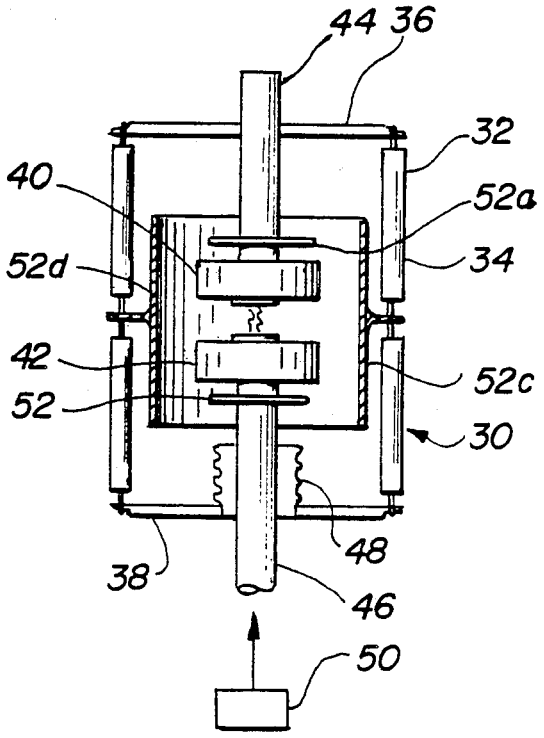
FIG. 1 is a cross-sectional view of a vacuum interrupter including electrodes designed in accordance with the preferred embodiment.

Referring to FIG. 1, a vacuum interrupter 30 is presented. The interrupter is comprised of a vacuum vessel 32. The vacuum vessel 32 is defined by an outer insulating cylinder 34, a first end plate 36 mounted on one end of the cylinder, and a second end plate 38 mounted on the other end of the cylinder 34. The end plate 36 and 38 are hermetically sealed to maintain a vacuum.

Centered in the vacuum vessel 32 are two opposing electrodes, a first electrode 40 and a second electrode 42, both having reciprocal geometries. The first electrode 40 is stationary and mounted to a conductor 44. The second electrode 42 is moveable and mounted to conductor 46. The second or movable electrode 42 is separated from the first electrode 40 when an extensive (overload) current is seen across the two. An external detection device (not shown), monitors the current flow and when an overload current is detected a separator 50 pulls the moveable electrode 42 away from the first electrode 40. The separation breaks the flow of current with the exception of any arc 54.

A metal bellows 48 is provided between the movable electrode and the end plate 38 along the conductor 46. The bellows bridges the moveable conductor 46 allowing electrode 42 to translate in and out of contact with the first electrode 40. The end plate 38 and bellows are configured to facilitate movement of the conductor 46 without affecting the vacuum integrity of the vessel.

Surrounding the electrodes are a plurality of shields 52*a*–52*d*. The shields protect against extraneous arcs. Shields 52*a* and 52*b* protect against arcs between the electrodes 40 and 42 and their respective conductors. Shields 52*c* and 52*d* protect against arcs between the electrodes 40 and 42 and the insulating cylinder 34 which may be made, for example, of a ceramic or glass material. More specifically, the shields 52*c* and 52*d*, which are supported inside the insulating cylinder 34, prevent metallic vapor caused by the arc to be deposited on the inner surface of the cylinder 34.

Figure 2:
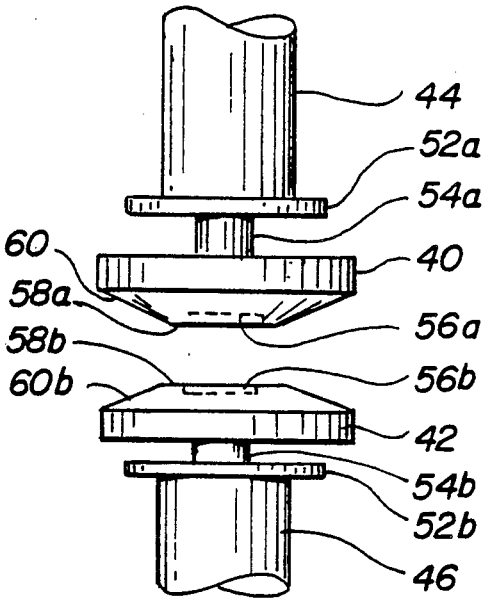
FIG. 2 is an enlarged view of the alignment of the electrodes of the present invention in a vacuum interrupter.

The principle behind the electrode of the preferred embodiment lies in its configuration. Referring to FIG. 2, a close-up of the two opposing electrodes 40 and 42 having reciprocal geometries is presented. Between each electrode and its conductor is a base 54*a* and 54*b* to which the respective electrodes are mounted. On the other side of the electrode 40 or 42 from its base 54*a* or 54*b* respectively, is a depressed planar region 56*a* or 56*b*, represented by the dotted lines. Each of the depressed regions 56*a* or 56*b* is encircled by a contact face 58*a* or 58*b*. Surrounding each contact face 58 is an outer circumferential plane 60*a* or 60*b*.

Figure 3:
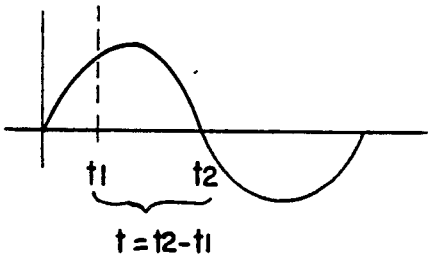
FIG. 3 is a graph of current verses time: current along the vertical axis, time along the horizontal axis.

Referring to FIG. 3, if the electrodes are separated at time $t_1$ an arc will exist between the electrodes 42 and 42 until time $t_2$. The arc will last for a time $t=t_2-t_1$.

Referring again to FIG. 2, the contact face 58 is located radially outward from the depressed planer region 56. This is so the path of the current makes a right angle as it approaches the depressed portion, from the base, and again as it flows across the contact face 58*b* into contact 58*a*. The current path is demonstrated by the dashed-dotted line. The portion of the current which flows parallel to the electrode face creates a magnetic field which causes the arc to move outward away from the contact faces 58*a* and 58*b* and on to the outer circumferential plane 60. The outer circumferential plane 60 is sloped away from the contact faces 56 so that any damage to the plane caused by arcing does not affect dielectrically the contact surface 58 of the electrodes 40 and 42.

Referring now to FIG. 6, a demonstration is provided of how the magnetic field causes the arc to move radially outward.

Two charged electrodes produce an electric field. An electric field produces a magnetic field at a right angle thereto. Since the arc contains metal vapor it is affected by the magnetic field and pushed to the outer circumferential plane 60 of the electrode. The path 62 denotes the flow of current in the moveable electrode 42. The path 64 denotes the current flow in the stationary electrode. Symbol 66 denotes the magnetic field created by the current through the electrode.

The ability of electrodes 40 and 42 to be configured so that they force an arc to move to the outer edge of the electrode face 40 and 42 is well known in the art, with exception to the size of the electrode required to efficiently and quickly move the arc out. FIG. 7 illustrates the electrode of the present invention which is generally indicated by reference number 70 in that figure. It is shown in FIG. 7(*a*) from a top view and from 7(*b*) in cross-section. The electrode 70 is an advancement over the prior art. Not only is it reduced in size from the prior art while maintaining the same rating, but it also eliminates arc stalling, thereby significantly extending the life of interrupter device 30.

The arc stalling eliminating electrode 70 has an inner planar portion 72. Surrounding the inner planar portion 72 is the contact face 74. Surrounding the contact faces is an outer circumferential plane 76 which slopes away (into the paper in FIG. 7(*a*)) from the contact face 74. The inner portion 72 serves the same function as the inner portion 56 of FIG. 2. Likewise the contact face 74 and the outer circumferential plane 76 serve the same function as their counterparts in FIG. 2. That is, the arc initiated at the contact face 74 at electrode separation is immediately moved out to the outer circumferential plane 76 so that no damage occurs to the contact face 74. The advantageous features of the arc stalling eliminating electrode 70 lies in its geometry.

As is evident from FIG. 7, a plurality of slots are cut through the arc stalling eliminating electrode 70. Four slots are shown in FIG. 7 but another number such as three or five or six may be sufficient. It all depends on the consistency of the materials used and the size of voltage current run through the electrodes. The exact number of such slots can be readily determined in view of the teachings herein. The slots define a plurality of flanges 78–84. The flanges 78–84 are designed so that the arc is free to move from the contact face to the outer circumferential plane 76 without any obstruction, i.e., so it can move away from the contact faces as rapidly as possible. Additionally, the electrode 70 is configured so that once the arc has moved to the outermost portion of a particular flange it can easily jump over to the next flange without stalling.

What allows the preferred embodiment to achieve these results where the prior art has failed is its geometry as defined by the slots. Referring to FIG. 8, the dimensions of one slot are isolated. The dimension however, of one slot is representative of the others because they are all of substantially the same width and curve. The geometries of the electrode flanges 78–84 are optimized by the following mathematical relationship. An initial bore is made a distance r1 above the center of the electrode. The bore has a diameter d which has been calculated to maximize heat dissipation while at the same time maximizing arc rotation around the outer circumferential plane 76 without stalling. The radius of the slot has an incrementally increasing radius of curvature which is defined by the following equations:

$$r2=(D+d)/2 \quad (1)$$

$$r1=r2/(\phi\times\sin\theta+1 \quad (2)$$

$$r2'=r1+(r2-r1/\phi)\phi' \quad (3)$$

where:

D = electrode diameter d = slot diameter r1 = initial radius of slot center r2 = radius of slot center at final position $\theta$ = angular increment of r2

$\phi$ = total angle of r2 r2′ = radius of slot center $\phi'$ = angle of r2′.

Referring again to FIG. 7, the curved flanges 78–84 are configured to quickly move the arc toward the outer circumferential plane 76 and to maintain its continuous rotation over the entire electrode surface. The arc is enhanced effectively by the self-induced magnetic field set up by the geometry of the electrode flanges 78–84 such that the arc is not inhibited for the radial motion as well as the arc transfer between electrode flange peripheries. Focusing on the curve of the electrode flanges 78–84, the curve is smooth and continuous. There are no sharp angles which an arc would have to negotiate thus stalling it. The large mass of metal which comprises the flange, and its uniform thickness maximize quick resistanceless movement to the periphery. Thus, arc stalling is effectively eliminated in the arc's path to the periphery while at the same time the slots dissipate heat caused by the arc.

Figure 4:
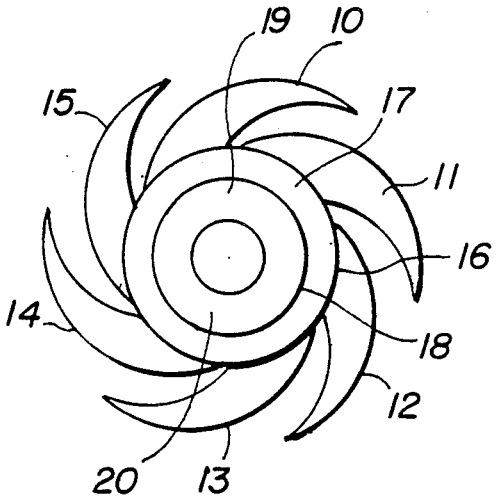
FIG. 4 is a top view of an electrode of the prior art.

As the flanges 78–84 approach the periphery (or the outer edge of the outer circumferential plane 76) the flanges 78–84 taper to a point. As an arc approaches one of these points it is at such a close proximity to the adjacent flange, and the adjacent flange has such a large adjacent area, that the arc moves freely from the tapered point of one flange on to the adjacent flange without stalling. Thereby, an arc is not isolated on to one flange as in the configuration of FIG. 4 discussed above. Rather it is passed on to the next flange before the preceding flange can be heated to the point of pitting or melting.

Thus, the configuration of the preferred embodiment moves the arc from the contact faces to the periphery without stalling, and around the periphery from flange to flange without stalling.

Referring to FIG. 7(*b*), a cross-sectional view of the arc stalling eliminating electrode 70 is shown. The inner planar portion 72 is shown depressed beneath the contact face 74. The outer circumferential plane 76 is shown sloped away from the contact face 74. It is important to note that the distance d2 is significantly less than the electrode of the prior art shown in FIG. 5. However, its rating is the same. This is because the electrodes of the prior art relied on having a large distance between the contact face and the ends of the flanges. The rationale being that by making the distance to the flanges relatively long, the heat would be removed a greater distance from the contact face thereby reducing the amount of heat at the contact face and the damage occurring to the face caused by the heat.

The preferred embodiment, contrarily, is able to move the arc out away from the contact face, reducing the initiation of heating therein, and can rotate it around the exterior of the flanges without allowing the heat generated by stalling to be produced. Since the arc moves relatively rapidly there is less stalling and, therefore, less heat to contend with. By allowing less heat to be produced (minimizing stalling) and moving the arc around the exterior without stalling, the electrode 70 can handle currents previously limited to larger prior art electrodes.

The attainment of the above may be achieved through use of the novel arc stalling eliminating electrode of the preferred embodiment. An arc stalling eliminating electrode in accordance with the preferred embodiment has a sealed vacuum vessel 32 within which are a pair of confronting electrodes 40 and 42 disposed within the vessel 32 and mounted for movement between a first closed position in which the electrodes 40 and 42 have contact faces 58 which engage one another and a second open position in which the contact faces 58 are spaced apart.

It should be further apparent to those skilled in the art that various changes in form and details of the invention as shown and described may be made. It is intended that such changes be included within the spirit and scope of the claims appended hereto.

What is claimed is:

1. A high voltage interrupter, comprising:

a sealed vessel;

a pair of confronting electrodes disposed within said vessel and mounted for movement between a first closed position in which said electrodes have contact faces which engage one another and a second open position in which said contact faces are spaced apart;

means for moving said confronting electrodes between said first and second positions when a high voltage AC current appears across said electrodes in order to interrupt that current, whereby said current generates an arc between said electrodes until said current goes to zero;

wherein each of said electrodes are fabricated from a common material and has a specific geometry defining a central depressed region, said contact face, a circumferential periphery sloped away from said contact face and a plurality of flanges, each of said flanges originating in said contact face at said depressed region and continuing to said sloped circumferential periphery;

said flanges being further defined by a plurality of slots equal in number to said plurality of flanges and separating said flanges from one another, said slots originating in said contact face immediately adjacent said depressed region to sufficiently space said flanges from one another so that an arc emanating on one flange necessarily propagates to the periphery of that flange and does not propagate along said contact face to an adjacent flange;

each of said slots having a uniform width and being defined by an incrementally increasing radius of curvature;

said electrodes being further configured such that said arc generated during separation of said electrode faces is caused to move rapidly to said circumferential periphery of said electrodes and around said circumferential periphery with substantially no stalling, whereby metal vapor from arcing is minimized.

2. The high voltage interrupter of claim 1 wherein said incrementally increasing radius of each slot is defined by the following equations:

$$r2=(D+d)/2$$

$$r1=r2/(\phi x \times \sin\theta+1)$$

$$r2'=r1+((r2-r1)/\phi)\phi',$$

where:

D is a diameter of each electrode d is a uniform width of said slot r1 is an initial radius of each slot r2 is a radius of each slot at a final position $\theta$ is an angular increment of r2

$\phi$ is an angle of r2 at said final position r2' is an incremental radius of each slot $\phi'$ is an incremental angle of r2'.

3. A pair of electrodes for use in a high voltage interrupter having a sealed vessel, said pair of confronting electrodes disposed within said vessel and mounted for movement between a first closed position in which the electrodes have contact faces which engage one another and a second open position in which said contact faces are spaced apart, and means for moving said confronting electrodes between said first and second positions when a high voltage AC current appears across the electrodes in order to interrupt that current, such that said interrupted current generates an arc between the electrodes until said arc goes to zero, each of said electrodes being a mirror image of each other and comprising:

an electrode body configured such that an arc generated during separation of said electrode contact faces in caused to move to an outer periphery of said electrodes an around said periphery with substantially no stalling;

wherein each of said electrodes is fabricated from a common material and has a specific geometry defining a central depressed region, said contact face, said periphery sloped away from said contact face and a plurality of flanges, each of said flanges originating in said contact face at said depressed region and continuing to said sloped periphery;

said flanges being further defined by a plurality of slots equal in number to said plurality of flanges and separating said flanges from one another, said slots originating in said contact face immediately adjacent said depressed region to sufficiently space said flanges from one another so that an arc emanating on one flange necessarily propagates to the periphery of that flange and does not propagate along said contact face to an adjacent flange;

each of said slots having a uniform width and being defined by an incrementally increasing radius of curvature.

* * * * *